US010934967B2

(12) United States Patent
Jenness et al.

(10) Patent No.: US 10,934,967 B2
(45) Date of Patent: Mar. 2, 2021

(54) THERMAL BARRIER CYLINDER LINER INSERT

(71) Applicant: Tenneco Inc., Lake Forest, IL (US)

(72) Inventors: Blair Matthew Jenness, Grosse Pointe Park, MI (US); Markus Aumiller, Friedberg (DE)

(73) Assignee: Tenneco Inc., Lake Forest, IL (US)

( * ) Notice: Subject to any disclaimer, the term of this patent is extended or adjusted under 35 U.S.C. 154(b) by 13 days.

(21) Appl. No.: 16/203,188

(22) Filed: Nov. 28, 2018

(65) Prior Publication Data

US 2020/0166001 A1 May 28, 2020

(51) Int. Cl.
*F02F 1/00* (2006.01)
*C23C 28/00* (2006.01)

(52) U.S. Cl.
CPC ..... *F02F 1/004* (2013.01); *C23C 28/3455* (2013.01); *F05C 2251/048* (2013.01)

(58) Field of Classification Search
CPC . F02F 1/004; C23C 28/3455; F05C 2251/048
See application file for complete search history.

(56) References Cited

U.S. PATENT DOCUMENTS 5,829,405 A 11/1998 Gödel
6,354,259 B2 3/2002 Fischer et al.
7,191,770 B1 3/2007 Anderson et al.
9,657,682 B2 * 5/2017 Graham ..... F02F 1/004
2013/0055993 A1 3/2013 Kantola et al.
2016/0040620 A1 2/2016 Highum
2017/0328299 A1 11/2017 Kim et al.

OTHER PUBLICATIONS

Guruprakash, V., Thermal Barrier coating on I.C engine cylinder liner, Sep. 2016, World Academy of Materials and Manufacturing Enginerring, vol. 81, Issue 1, pp. 37-41 (Year: 2016).*

* cited by examiner

*Primary Examiner* — Jacob M Amick
*Assistant Examiner* — Charles Brauch
(74) *Attorney, Agent, or Firm* — Robert L. Stearns; Dickinson Wright, PLLC

(57) ABSTRACT

An insert for a cylinder liner which is capable of trapping heat in the combustion chamber is provided. The insert extends circumferentially around a center axis and longitudinally from an upper end to a lower end. The insert includes an inner portion presenting an inner surface facing the center axis and an outer portion presenting an outer surface facing away from the center axis. The inner portion is formed of an iron-based material, such as steel, and the outer portion is formed of a material having a thermal conductivity of not greater than 3.5 W/mK, for example ceria stabilized zirconia. The inner and outer portions each present a thickness, and the thickness can form a gradient between the upper end and the lower end of the insert. For example, the thickness of the outer portion can be greater at the upper end than at the lower end of the insert.

20 Claims, 2 Drawing Sheets

THERMAL BARRIER CYLINDER LINER INSERT

BACKGROUND

1. Field of the Invention

This invention relates generally to cylinder liners for internal combustion engines, and methods of manufacturing the cylinder liners.

2. Related Art

Engine blocks of internal combustion engines include cylindrical shaped openings for receiving cylinder liners. Each cylinder liner presents an inner surface surrounding the cylindrical opening for receiving a piston. The rings of the piston slide along the inner surface of the cylinder liner during operation of the engine.

SUMMARY

One aspect of the invention provides an insert for a cylinder liner of an internal combustion engine. The insert includes an insert body extending circumferentially around a center axis and longitudinally from an upper end to a lower end. The insert body includes an inner portion presenting an inner surface facing the center axis, and the inner surface presents an opening. The insert body also includes an outer portion presenting an outer surface facing away from the center axis. The inner portion is formed of an iron-based material, and the outer portion is formed of a material having a thermal conductivity of not greater than 3.5 W/mK.

Another aspect of the invention provides a cylinder liner for an internal combustion engine. The cylinder liner includes a liner body extending circumferentially around a center axis and longitudinally from a top end to a bottom end. The liner body presents an interior surface facing the center axis. The cylinder liner also includes an insert body disposed along the interior surface of the liner body. The insert body extends circumferentially around the center axis and longitudinally from an upper end to a lower end. The insert body includes an inner portion presenting an inner surface facing the center axis, and the inner surface presents an opening. The insert body also includes an outer portion presenting an outer surface facing away from the center axis. The outer surface of the outer portion engages the interior surface of the liner body. The inner portion of the insert body is formed of an iron-based material, and the outer portion of the insert body is formed of a material having a thermal conductivity of not greater than 3.5 W/mK.

Yet another aspect of the invention provides a method of manufacturing an insert for a cylinder liner of an internal combustion engine. The method comprises the steps of forming an insert body by providing an inner portion formed of an iron-based material and presenting an inner surface facing and extending circumferentially around a center axis and presenting an opening, and applying a material having a thermal conductivity of not greater than 3.5 W/mK to an exterior surface of the inner portion to form an outer portion presenting an outer surface facing away from the center axis.

Another aspect of the invention provides a method of manufacturing a cylinder liner for an internal combustion engine. The method comprises the steps of providing a liner body extending circumferentially around a center axis and longitudinally from a top end to a bottom end, the liner body presenting an interior surface facing the center axis; and disposing an insert body along the interior surface of the liner body. The insert body extends circumferentially around the center axis and longitudinally from an upper end to a lower end. The insert body includes an inner portion presenting an inner surface facing the center axis, and the inner surface presents an opening. The insert body also includes an outer portion presenting an outer surface facing away from the center axis. The outer surface of the outer portion engages the interior surface of the liner body. The inner portion is formed of an iron-based material, and the outer portion is formed of a material having a thermal conductivity of not greater than 3.5 W/mK.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXEMPLARY EMBODIMENTS

The invention provides an insert 10 for a cylinder liner of an internal combustion engine, and a cylinder liner 12 which includes the insert 10. An example of the insert 10 for the cylinder liner 12 is shown in FIG. 1, and an example of the cylinder liner 12 including the insert 10 is shown in FIGS. 2, 2A, and 2B.

Figure 1:
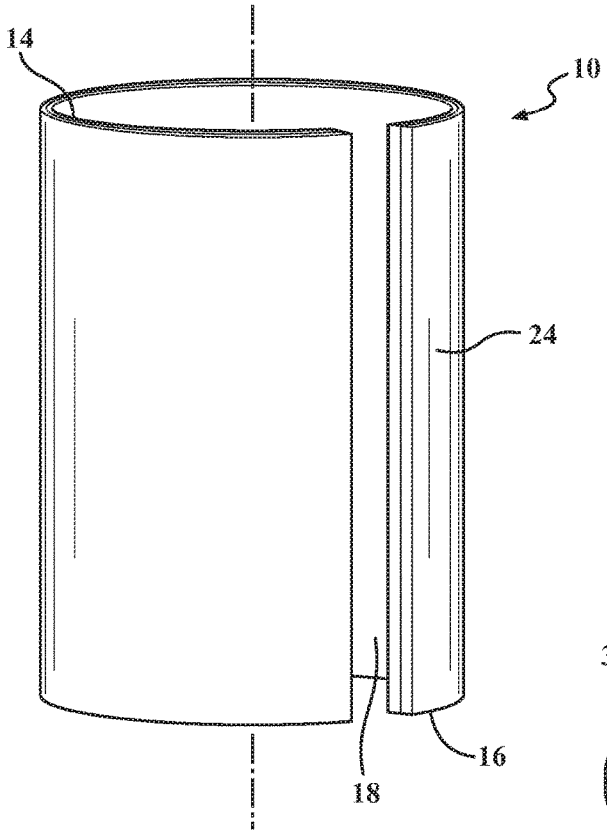
FIG. 1 is a perspective view of an insert for a cylinder liner according to an example embodiment.
Figure 2:
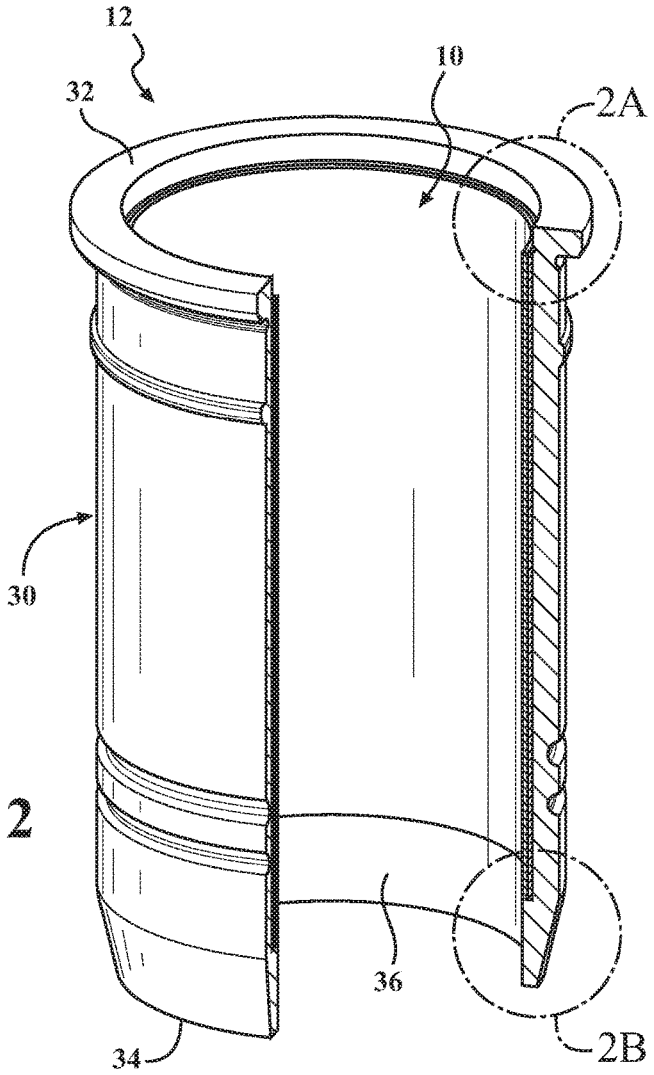
FIG. 2 is a perspective and partial cross-sectional view of a cylinder liner including the insert according to an example embodiment.
Figure 2A:
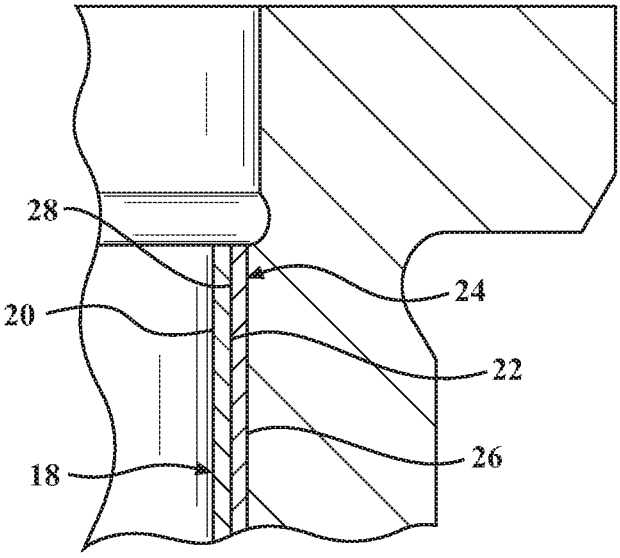
FIG. 2A is an enlarged view of a portion of FIG. 2 adjacent an upper end of the cylinder liner.
Figure 2B:
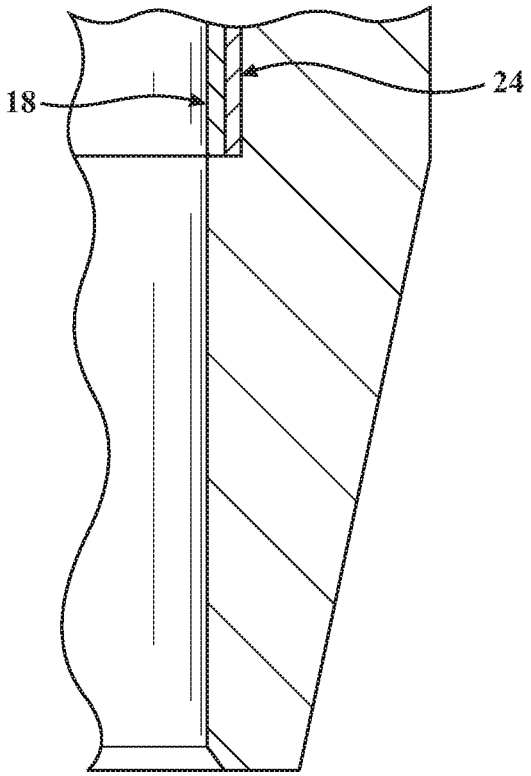
FIG. 2B is an enlarged view of a portion of FIG. 2 adjacent a lower end of the cylinder liner.

As shown in FIG. 1, the insert 12 includes an insert body extending circumferentially around a center axis A and longitudinally from an upper end 14 to a lower end 16. The insert body includes an inner portion 18 presenting an inner surface 20 facing the center axis A. The inner surface 20 presents an opening for receiving a piston, and piston rings surrounding the piston typically slide along the inner surface 20 of the insert body. The inner portion 18 also includes an exterior surface 22 facing away from the center axis A. The inner portion 18 is formed of an iron-based material, for example steel. The inner portion 18 can be formed by spraying the iron-based material onto a mandrel, and then removing the iron-based material from the mandrel.

The insert body also includes an outer portion 24 presenting an outer surface 26 facing away from the center axis A. The outer portion 24 includes an interior surface 28 facing toward the center axis A, and the interior surface 28 of the outer portion 24 engages the exterior surface 22 of the inner portion 18. The outer portion 24 is formed of a material having a thermal conductivity of not greater than 3.5 W/mK. For example, the outer portion 24 can be formed of a material including ceria and/or zirconia. According to one embodiment, the outer portion 24 is formed of ceria stabilized zirconia.

The outer portion 24 and the inner portion 18 each have a thickness, and the thicknesses can vary between the upper end 14 to the lower end 16. For example, the thicknesses could present a gradient between the upper end 14 and the lower end 16. According to one embodiment, the thickness of the outer portion 24 formed of the material having a thermal conductivity of not greater than 3.5 W/mK is greater at the upper end 14 than the bottom end 16. For example, the thickness of the outer portion 14 decreases from the upper end 14 to the lower end 16.

The insert body can optionally include a bonding layer applied to the outer portion 24 for bonding to the engine block, which is typically a block casting. According to this embodiment, the outer portion 24 formed of the material having a thermal conductivity of not greater than 3.5 W/mK is actually a middle layer of the insert 10.

Another aspect of the invention provides the cylinder liner for an internal combustion engine including the insert. The cylinder liner includes a liner body 30 extending circumferentially around the center axis and longitudinally from a top end 32 to a bottom end 34. The liner body is typically formed of a metal material, such as steel. The liner body presents an interior surface 36 facing the center axis. The liner body is formed of a metal, such as steel. The insert body is disposed along the interior surface of the liner body. The outer surface of the outer portion of the insert is disposed along and engages the interior surface of the liner body.

Another aspect of the invention provides a method of manufacturing the insert for the cylinder liner of the internal combustion engine. The method includes forming the insert body by providing the inner portion formed of the iron-based material, and then applying the material having a thermal conductivity of not greater than 3.5 W/mK to the exterior surface of the inner portion to form the outer portion.

According to an example embodiment, the inner portion and the outer portion are formed by spraying. For example, the method can first include surface activation of a mandrel, and then spraying the iron-based material onto the mandrel to form the inner portion. Next, the method includes removing the inner portion from the mandrel. The method further includes spraying the material having a thermal conductivity of not greater than 3.5 W/mK, for example ceria stabilized zirconia, to the exterior surface of the inner portion to form the outer portion. The method also includes machining the outer portion.

Yet another aspect of the invention provides a method of manufacturing the cylinder liner for the internal combustion engine. The method comprises the steps of providing the liner body, and disposing the insert body along the interior surface of the liner body. The method can include machining the liner body.

The insert provides the advantage of trapping heat in the combustion chamber of the cylindrical opening during operation of the internal combustion engine, like a thermal barrier coating on a piston or on the outer diameter of the liner would do. However, when the thermal barrier coating is disposed on the outer diameter of the cylinder liner, there are challenging tolerances after the coating process and dimensions on the outer diameter of the liner which are difficult to deal with.

Another advantage is that the inner portion of the insert formed of steel provides a normal surface for the piston rings and piston to interact with, while the outer portion of the insert acts as a thermal barrier coating to interrupt the heat flow out of the combustion chamber.

Obviously, many modifications and variations of the present invention are possible in light of the above teachings and may be practiced otherwise than as specifically described while within the scope of the claims. It is contemplated that all features described and of all embodiments can be combined with each other, so long as such combinations would not contradict one another.

What is claimed is:

1. An insert for a cylinder liner of an internal combustion engine, an insert body extending circumferentially around a center axis and longitudinally from an upper end to a lower end, said insert body including an inner portion presenting an inner surface facing said center axis, said inner surface presenting an opening, said insert body including an outer portion presenting an outer surface facing away from said center axis, said outer portion being longitudinally aligned with and disposed radially outwardly of said inner portion, said outer portion being sprayed onto said inner portion, and said inner portion being formed of an iron-based material and said outer portion being formed of a material having a thermal conductivity of not greater than 3.5 W/mK.

2. An insert for a cylinder liner according to claim 1, wherein said inner portion is formed of steel.

3. An insert for a cylinder liner according to claim 1, wherein said outer portion is formed of a material including zirconia and/or ceria.

4. An insert for a cylinder liner according to claim 1, wherein said outer portion is formed of ceria stabilized zirconia.

5. An insert for a cylinder liner according to claim 1, wherein said inner portion and said outer portion each present a thickness, and the thickness of said outer portion is greater at said upper end than at said lower end.

6. An insert for a cylinder liner according to claim 1, wherein said inner portion includes an exterior surface facing away from said center axis, said outer portion includes an interior surface facing toward said center axis, said interior surface of said outer portion engages said exterior surface of said inner portion, said inner portion is formed of steel, and said outer portion is formed of a material including ceria stabilized zirconia.

7. A cylinder liner for an internal combustion engine, comprising:

a liner body extending circumferentially around a center axis and longitudinally from a top end to a bottom end, said liner body having a length extending from said top end to said bottom end, said liner body presenting an interior surface facing said center axis, an insert body disposed along said interior surface of said liner body, said insert body extending circumferentially around said center axis and longitudinally from an upper end to a lower end, said insert body extending along a majority of said length of said liner body, said insert body including an inner portion presenting an inner surface facing said center axis, said inner surface presenting an opening, and said inner surface being exposed for engaging a piston and/or piston ring, said insert body including an outer portion presenting an outer surface facing away from said center axis, said outer portion being longitudinally aligned with and disposed radially outwardly of said inner portion, said outer surface of said outer portion engaging said interior surface of said liner body, said inner portion being formed of an iron-based material, and said outer portion being formed of a material having a thermal conductivity of not greater than 3.5 W/mK.

8. A cylinder liner according to claim 7, wherein said inner portion of said insert body is formed of steel and said outer portion of said insert body is formed of a material including zirconia and/or ceria.

9. A cylinder liner according to claim 7, wherein said outer portion of said insert body is formed of ceria stabilized zirconia.

10. A cylinder liner according to claim 7, wherein said inner portion of said insert body includes an exterior surface facing away from said center axis, said outer portion includes an interior surface facing toward said center axis, said interior surface of said outer portion engages said exterior surface of said inner portion, said inner portion is formed of steel, and said outer portion is formed of a material including ceria stabilized zirconia.

11. A method of manufacturing an insert for a cylinder liner of an internal combustion engine, comprising the steps of:

forming an insert body by providing an inner portion formed of an iron-based material and presenting an inner surface facing and extending circumferentially around a center axis and presenting an opening, and spraying an exterior surface of the inner portion with a material having a thermal conductivity of not greater than 3.5 W/mK to form an outer portion presenting an outer surface facing away from the center axis, the outer portion being longitudinally aligned with and disposed radially outwardly of the inner portion.

12. A method of manufacturing an insert according to claim 11, wherein the inner portion is formed of steel.

13. A method of manufacturing an insert according to claim 11, wherein the outer portion is formed of a material including ceria.

14. A method of manufacturing an insert according to claim 11, wherein the outer portion is formed of ceria stabilized zirconia.

15. A method of manufacturing an insert according to claim 11, wherein the inner portion includes an exterior surface facing away from the center axis, the outer portion includes an interior surface facing toward the center axis, the interior surface of the outer portion engages the exterior surface of the inner portion, the inner portion is formed of steel, the inner portion is formed by spraying, the outer portion is formed of a material including ceria stabilized zirconia, and the material including ceria stabilized zirconia is applied to the exterior surface of the inner portion by spraying.

16. A method of manufacturing a cylinder liner for an internal combustion engine, comprising the steps of:

providing a liner body extending circumferentially around a center axis and longitudinally from a top end to a bottom end, the liner body presenting an interior surface facing the center axis;

disposing an insert body along the interior surface of the liner body, the insert body extending circumferentially around the center axis and longitudinally from an upper end to a lower end, the insert body including an inner portion presenting an inner surface facing the center axis, the inner surface presenting an opening, the insert body including an outer portion presenting an outer surface facing away from the center axis, the outer portion being longitudinally aligned with and disposed radially outwardly of the inner portion, the outer surface of the outer portion engaging the interior surface of the liner body, the inner portion being formed of an iron-based material, and the outer portion being formed of a material having a thermal conductivity of not greater than 3.5 W/mK; and wherein the inner portion of the insert body is formed by spraying the iron-based material.

17. A method of manufacturing a cylinder liner according to claim 16, wherein the inner portion of the insert body is formed of steel.

18. A method of manufacturing a cylinder liner according to claim 16, wherein the outer portion of the insert body is formed of a material including ceria.

19. A method of manufacturing a cylinder liner according to claim 16, wherein the outer portion of the insert body is formed of ceria stabilized zirconia.

20. A method of manufacturing a cylinder liner according to claim 16, wherein the inner portion of the insert body includes an exterior surface facing away from the center axis, the outer portion includes an interior surface facing toward the center axis, the interior surface of the outer portion engages the exterior surface of the inner portion, the inner portion is formed of steel, the outer portion is formed of a material including ceria stabilized zirconia, and the outer portion is applied to the exterior surface of the inner portion by spraying.

* * * * *